US006989788B2

(12) United States Patent
Marion et al.

(10) Patent No.: US 6,989,788 B2
(45) Date of Patent: Jan. 24, 2006

(54) ANTENNA ARRAY HAVING APPARATUS FOR PRODUCING TIME-DELAYED MICROWAVE SIGNALS USING SELECTABLE TIME DELAY STAGES

(75) Inventors: Donald G. Marion, Amherst, NH (US); Annemarie Giza, Amherst, NH (US)

(73) Assignee: Continental Microwave & Tool Co., Inc., Exeter, NH (US)

( * ) Notice: Subject to any disclaimer, the term of this patent is extended or adjusted under 35 U.S.C. 154(b) by 123 days.

(21) Appl. No.: 10/244,576

(22) Filed: Sep. 16, 2002

(65) Prior Publication Data

US 2004/0051599 A1 Mar. 18, 2004

(51) Int. Cl.
*H01Q 3/22* (2006.01)

(52) U.S. Cl. ..... 342/375; 333/164

(58) Field of Classification Search ..... 333/161, 333/164, 156, 139; 342/371, 375
See application file for complete search history.

(56) References Cited

U.S. PATENT DOCUMENTS 3,295,138 A * 12/1966 Nelson ..... 333/164 X
3,568,097 A * 3/1971 Hyltin ..... 333/161
3,774,123 A * 11/1973 Hume ..... 333/104
4,586,047 A * 4/1986 Inacker et al. ..... 333/164 X
4,616,196 A * 10/1986 Sharma ..... 333/161
5,877,659 A * 3/1999 Knowles et al. ..... 333/164
6,157,343 A * 12/2000 Andersson et al. ..... 342/371
6,191,735 B1 * 2/2001 Schineller ..... 342/375
6,356,166 B1 * 3/2002 Goldsmith et al. ..... 333/161

FOREIGN PATENT DOCUMENTS

JP 123 201 * 5/1968 ..... 333/161
JP 165202 * 6/1989 ..... 333/164

* cited by examiner

*Primary Examiner*—Benny T. Lee
(74) *Attorney, Agent, or Firm*—Jaeckle Fleischmann & Mugel, LLP

(57) ABSTRACT

A scanned antenna array includes time delay stages each having at least one time delay sub-circuit. Each time delay sub-circuit includes a sub-circuit input, a sub-circuit output, a first delay line, and a second delay line. A first diode switch connects a first end of a selected one of the first and second delay lines to the sub-circuit input. A second diode switch connects a second end of the selected one of the first and second delay lines to the sub-circuit output. The sub-circuit output is connected to one of another time delay sub-circuit or to an output of the time delay stage. A respective transmit/receive (TR) module is coupled to an output of each time delay stage and issues a TR module output signal. A plurality of antenna elements radiate an output signal received from the corresponding TR module.

5 Claims, 8 Drawing Sheets

ANTENNA ARRAY HAVING APPARATUS FOR PRODUCING TIME-DELAYED MICROWAVE SIGNALS USING SELECTABLE TIME DELAY STAGES

FIELD OF THE INVENTION

The present invention relates generally to a method and apparatus for producing time delayed microwave signals for directional antenna beam patterning.

DESCRIPTION OF THE RELATED ART

Many modern electronic systems, such as systems for radar, communication and electronic countermeasures, utilize an electrically scanned antenna array. Scanned antenna arrays provide each antenna element with a signal from a time delay and/or phase shifting circuit such that each antenna element receives a signal that is slightly shifted in time and/or phase relative to the other antenna elements. The time-delayed or phase-shifted signals electronically form or shape the signal emitted from the antenna array into a desired pattern of radiation, sometimes referred to as a beam. The beam focuses the emitted signal to a desired location or in a desired direction.

Such time delay circuits typically include multiple stages, or sub-circuits, that are cascaded together (i.e., connected in series). Each sub-circuit includes a divider that routes the microwave signal through a reference line and a delay line. The delay line has a length that is a predetermined amount greater than the reference line, and thus the propagation time of the microwave signal through the delay line is delayed relative to the propagation time of the microwave signal through the reference line. The delay lines of the sub-circuits are typically arranged in binary sequence, such that the length of the delay lines in each sub-circuit increases according to the ratio of 1, 2, 4 . . . , $2^n$, and such a delay circuit is therefore sometimes referred to as a digital delay circuit. A switch in each sub-circuit selectively connects either the reference line or the delay line to an amplifier. The amplifier interfaces that sub-circuit with the next cascaded sub-circuit, and thus either the reference microwave signal or the delayed microwave signal is amplified and passed to the next sub-circuit.

The switches are typically discrete P-type semiconductor/Intrinsic/N-type semiconductor (PIN) diode switches, which have relatively predictable time delays and low insertion losses. However, discrete PIN diode switches have a limited operating frequency band and are relatively costly to produce in the quantities required. Further, such discrete PIN diode switches consume large amounts of space compared to integrated circuit devices. The amplifier in each time delay sub-circuit amplifies the microwave signal by a predetermined amount to compensate for the insertion losses of the switch and divider. However, the amplifiers render the delay circuit non-reciprocal (i.e., directional), and add complexity and cost to the device.

Each sub-circuit of a conventional delay circuit typically includes multiple discrete components, such as discrete PIN diodes configured as switches and including inductors, capacitors and resistors. Each of the components used in the sub-circuit, besides consuming relatively large amounts of space, have known and inherent characteristics and properties that can degrade performance. The circuits may require manual tuning in order to achieve and maintain acceptable overall performance of the system. Manually tuning the delay circuits is time consuming, and is not a process with high repeatability. Therefore, a relatively large degree of variation is likely to exist between the operating characteristics of different delay circuits, and extensive screening, testing and matching of delay circuits is likely to be required.

Since the sub-circuits are typically cascaded, any degradation in the performance of one sub-circuit is multiplied by the subsequent sub-circuits. Isolation devices are inserted between the sub-circuits to reduce the amount of degradation and/or error that is passed from one sub-circuit to a subsequent sub-circuit, thereby reducing the magnification of the degrading characteristics by the subsequent sub-circuit. However, isolation devices also render the delay circuit uni-directional or non-reciprocal, add complexity to the circuit, reduce the useable bandwidth, and make the circuit difficult to tune.

Therefore, what is needed in the art is a microwave time delay circuit that reduces the need for manual tuning.

Furthermore, what is needed in the art is a microwave time delay circuit that has a reduced number of discrete components relative to a conventional microwave time delay circuit.

Still further, what is needed in the art is a microwave time delay circuit that has an increased useable bandwidth relative to a conventional microwave time delay circuit.

Even further, what is needed in the art is a microwave time delay circuit having improved performance and repeatability in manufacture.

Yet further, what is needed in the art is a microwave delay circuit that eliminates the dividers and the insertion losses associated therewith.

Moreover, what is needed in the art is a microwave delay circuit that eliminates the need for an interfacing amplifier between stages.

Lastly, what is needed in the art is a microwave delay circuit that is reciprocal.

SUMMARY OF THE INVENTION

The present invention provides a method and apparatus for producing time-delayed microwave signals.

The invention comprises, in one form thereof, one or more time delay stages each having at least one time delay sub-circuit. Each time delay sub-circuit includes a sub-circuit input, a sub-circuit output, a first delay line, and a second delay line. A first diode switch connects a first end of a selected one of the first and second delay lines to the sub-circuit input. A second diode switch connects a second end of the selected one of the first and second delay lines to the sub-circuit output. The sub-circuit output is connected to either another time delay sub-circuit or to an output of the time delay stage. A respective transmit/receive (TR) module is coupled to an output of each time delay stage and issues a TR module output signal. A plurality of antenna elements radiate the TR module output signals.

An advantage of the present invention is that the need for manual tuning of the delay stages and/or sub-circuits is substantially reduced.

Another advantage of the present invention is the number of discrete components is substantially reduced relative to a conventional microwave time delay circuit.

Yet another advantage of the present invention is the useable bandwidth is substantially increased relative to a conventional microwave time delay circuit.

A further advantage of the present invention is the delay stages and/or sub-circuits have improved performance and repeatability in manufacture.

An even further advantage of the present invention is the use of dividers is eliminated, and thus the insertion losses associated therewith are also eliminated.

A still further advantage of the present invention is there is no need for an interfacing amplifier between delay stages and/or sub-circuits.

Yet a further advantage of the present invention is that the delay stages and/or sub-circuits are reciprocal.

Other advantages of the present invention will be obvious to one skilled in the art and/or appear hereinafter.

BRIEF DESCRIPTION OF THE DRAWINGS

The above-mentioned and other features and advantages of this invention, and the manner of attaining them, will become appreciated and be more readily understood by reference to the following detailed description of one embodiment of the invention in conjunction with the accompanying drawings, wherein.

Figure 1:
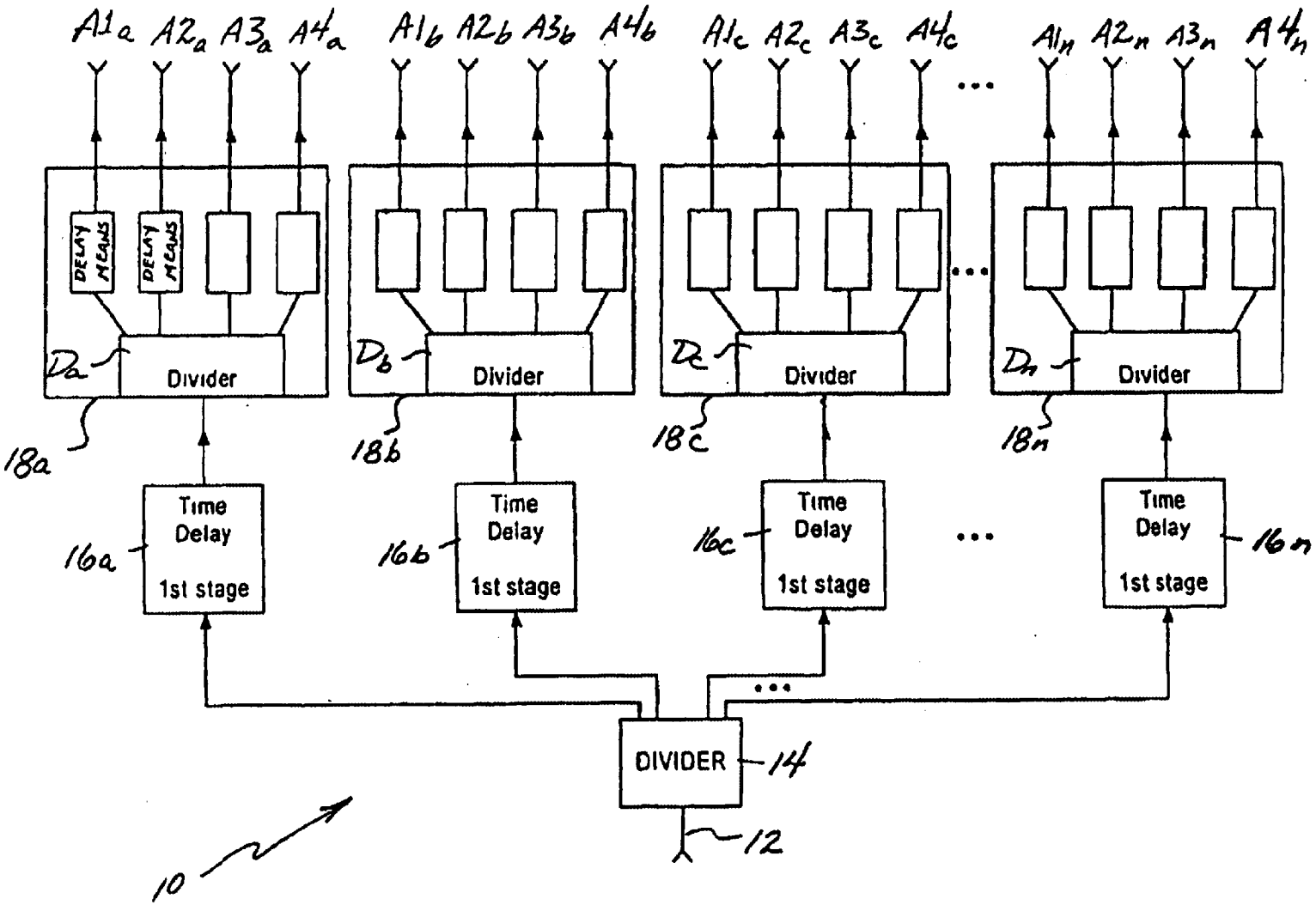
FIG. 1 PRIOR ART
FIG. 1 a block diagram of a conventional scanned antenna array system employing time-delay microwave signal processing.

Corresponding reference characters indicate corresponding parts throughout the several views and may not be described in detail for all views. The exemplification set out herein illustrates embodiment of the invention, in one form, and such exemplification is not to be construed as limiting the scope of the invention in any manner.

DETAILED DESCRIPTION OF THE DRAWINGS

Referring now to the drawings, and particularly to FIG. 1, a block diagram of a conventional scanned antenna array system employing time-delay microwave signal processing is shown. Antenna array system 10 receives microwave input signal 12, which is routed through divider 14 and to a plurality or N number of first delay stages or coarse delay stages 16*a*, 16*b*, 16*c*, . . . 16*n*. The first/coarse delay stages 16*a*–16*n* receive respective RF input signals from divider 14. Generally, each first/coarse delay stage 16*a*–16*n* performs coarse beam forming by delaying the RF input signal by a controlled amount of time.

A plurality or N number of second delay stages 18*a*, 18*b*, 18*c*, . . . 18*n* receive the time-delayed RF signals from a corresponding one of first/coarse delay stages 16*a*–16*n*. Each of second delay stages 18*a*–18*n* include dividers Da, Db, Dc, . . . , Dn, respectively, and time delay means (not referenced) which perform finer or more precise beam forming by further time delaying the RF signal in a controlled and predetermined manner. Second delay stages 18*a*–18*n* are coupled to corresponding antenna elements A1*a*, A2*a*, A3*a*, A4*a*; A1*b*, A2*b*, A3*b*, A4*b*; A1*c*, A2*c*, A3*c*, A4*c* . . . A1*n*, A2*n*, A3*n*, A4*n*, respectively, that radiate the time-delayed output signals supplied to each element by the corresponding delay means.

Figure 2:
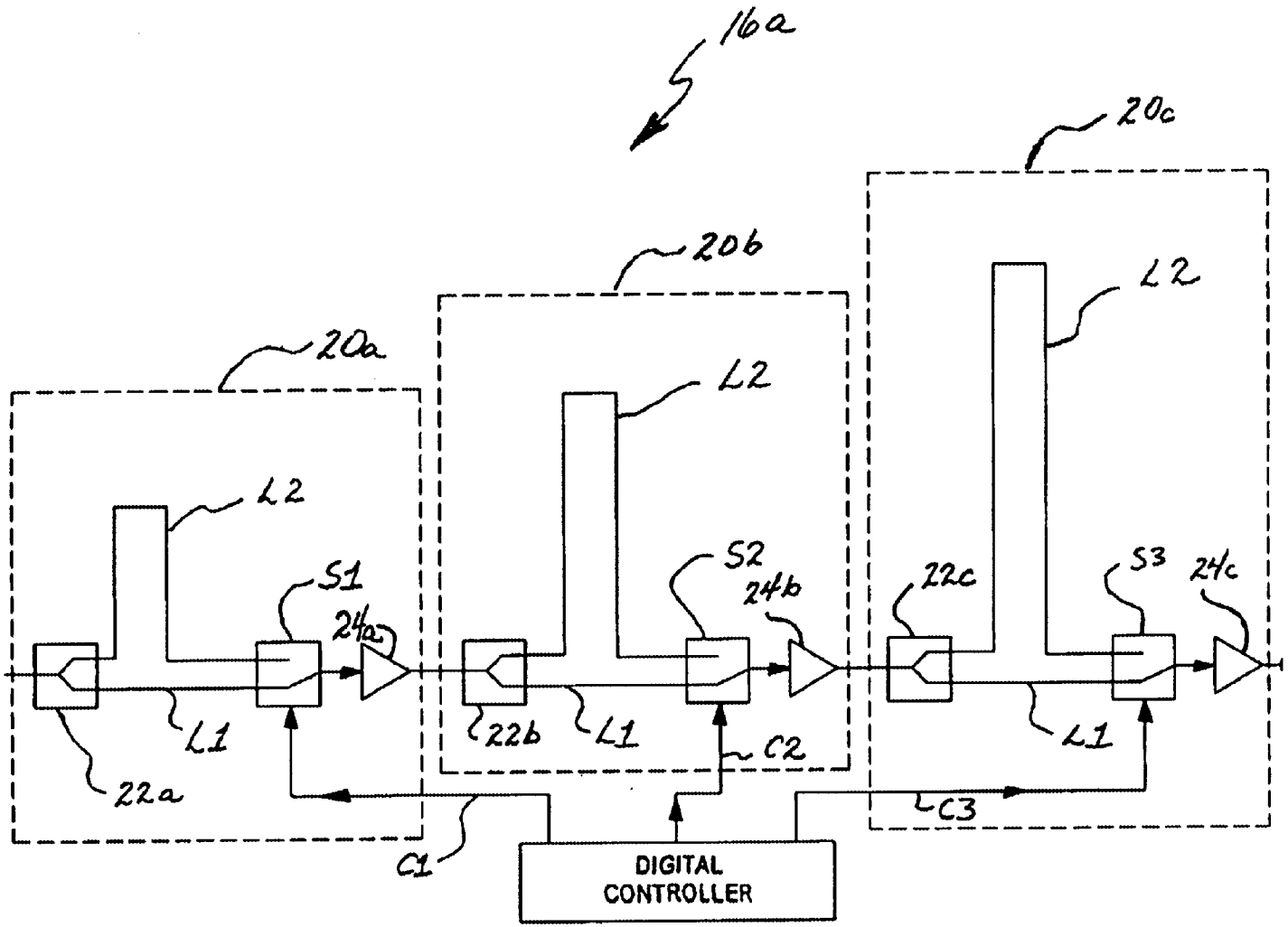
FIG. 2 PRIOR ART
FIG. 2 is a schematic diagram of one of the time delay stages of FIG. 1 and sub-circuits thereof.

First/coarse delay stages 16*a*–16*n* are substantially similar, and therefore a detailed description of one shall serve to describe the structure and functionality of all. Referring now to FIG. 2, a schematic diagram of a conventional first/coarse delay circuit 16*a* is shown. Time delay circuit 16*a* is a 3-bit time delay circuit including three sub-circuits 20*a*, 20*b*, 20*c*.

Sub-circuit 20*a* includes divider 22*a* that splits the RF input signal between delay lines L1 and L2. The length of line L2 is greater than the length of reference line L1, and thus introduces a time or propagation delay upon the RF signal routed therethrough relative to line L1. Switch S1, in response to control signal C1 from a digital controller (not referenced), connects one of delay lines L1 and L2 to amplifier 24*a*. Amplifier 24*a* amplifies the RF signal to compensate for the insertion loss of switch S1 and the approximate 3 dB loss attributable to divider 22*a*. Amplifier 24*a* issues the amplified RF signal to sub-circuit 20*b*. The RF signal issued by sub-circuit 20*a* is then processed in a manner substantially similar through sub-circuits 20*b* and 20*c*.

Sub-circuits 20*a*, 20*b* and 20*c* are substantially similar to each other in function and design and thus sub-circuits 20*b* and 20*c* are not discussed in detail individually. Generally, sub-circuits 20*b* and 20*c* include dividers 22*b*, 22*c*, respective delay lines L1 and L2, amplifiers 24*b*, 24*c*, and switches S2 and S3 receiving control signals C2 and C3, respectively. One distinction between sub-circuits 20*a*, 20*b* and 20*c* is that the ratio of their respective delay lines L2 to L1 increases by a factor of two from sub-circuit 20*a* to sub-circuit 20*b*, and from sub-circuit 20*b* to sub-circuit 20*c*. Thus, delay line L2 of sub-circuit 20*b* delays the RF signal twice as long as delay line L2 of sub-circuit 20*a*. Similarly, delay line L2 of sub-circuit 20*c* delays the RF signal twice as long as delay line L2 of sub-circuit 20*b*. Delay lines L1 of each of sub-circuits 20*a*, 20*b*, 20*c* are substantially equal in at least one of length and the amount of time by which they delay the RF signal.

As stated above, each of sub-circuits 20*a*, 20*b* and 20*c* include dividers 22*a*, 22*b* and 22*c*, switches S1, S2 and S3 which receive control signals C1, C2 and C3, and amplifiers 24*a*, 24*b*, and 24*c*, respectively. Thus, each of sub-circuits 20*a*, 20*b* and 20*c* include a plurality of discrete components. Amplifiers 24*a*, 24*b*, 24*c* compensate for the insertion losses associated with dividers 22*a*, 22*b*, 22*c*, respectively, but render the delay sub-circuits 20*a*, 20*b*, 20*c* nonreciprocal.

Although not shown in FIG. 1 or 2, each of discrete switches S1, S2 and S3 include a plurality of discrete components, such as, for example, inductors and capacitors. These discrete components consume a relatively large amount of space and have known and inherent characteristics, such as, for example, parasitic capacitances and inductances, that can degrade performance of antenna system 10. Thus, sub-circuits 20*a*, 20*b* and 20*c* may require manual tuning in order to achieve and maintain an acceptable level of performance by antenna system 10.

Figure 3:
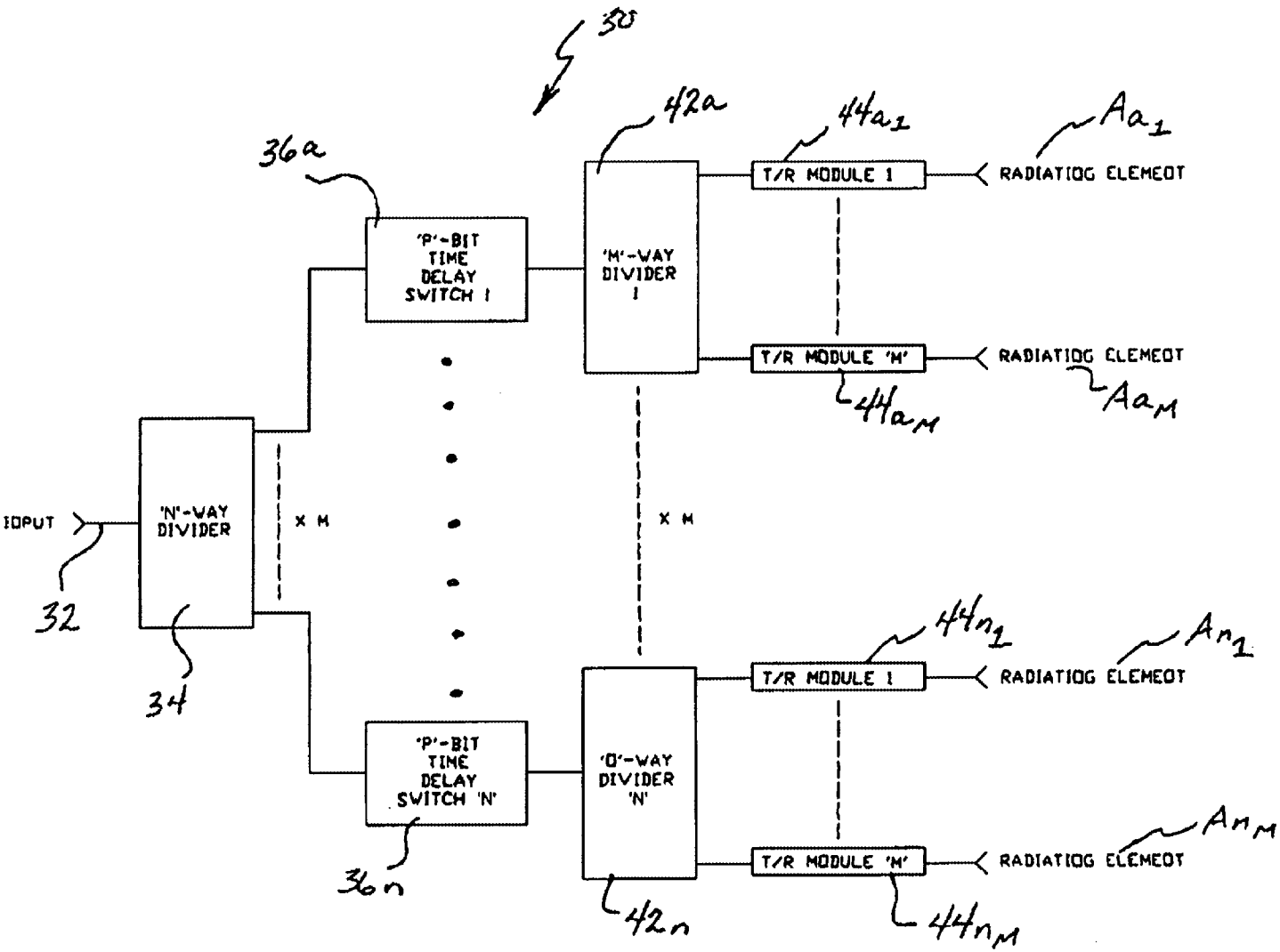
FIG. 3 is a block diagram of one embodiment of a scanned antenna array system of the present invention.

Referring now to FIG. 3, one embodiment of a microwave scanned antenna array system of the present invention is shown. Microwave scanned antenna array system 30 receives RF input signal 32, and includes N-way divider 34, N number of 'P'-Bit time delay stages 36*a*, . . . , 36*n* (only two shown). Antenna array system 30 further includes N number of M-way dividers 42*a*, . . . , 42*n* (only two shown), each of which are associated with a corresponding M number of transmit/receive (T/R) modules 44*a*1, . . . , 44*a*M, 44*n*1, . . . , 44*n*M, respectively. Generally, antenna array system 30 receives input signal 32, which is routed through N-way divider 34 to each of time delay stages 36*a*, . . . , 36*n*. Delay stages 36*a*, . . . , 36*n*, perform coarse beam forming by delaying the RF input signal by a controlled amount of time. The coarse-formed or delayed signals are then supplied to T/R modules 44*a*1, . . . , 44*a*M through 44*n*1, . . . , 44*n*M via M-way dividers 42*a*–42*n*, respectively. T/R modules 44*a*1, . . . , 44*a*M through 44*n*1, . . . , 44*n*M each include M number of time delay means (not shown). M-way dividers 42*a*, . . . , 42*n* route the signal supplied to each of TIR modules 44*a*1, . . . , 44*a*M through 44*n*1, . . . , 44*n*M into their respective M delay means, such as conventional digital phase shift and/or amplifier circuits, that perform the finer or more precise beam forming of the output signal by further time delaying the RF signal in a controlled and predetermined manner as is known in the art. T/R modules 44*a*1, . . . , 44*a*M through 44*n*1, . . . , 44*n*M each provide M output signals to a corresponding M number of radiating elements Aa1, . . . , AaM through An1, . . . , AnM respectively, which radiate the time-delayed output signals and thereby form an emitted signal having a predetermined direction and focus, or beam pattern.

Figure 4:
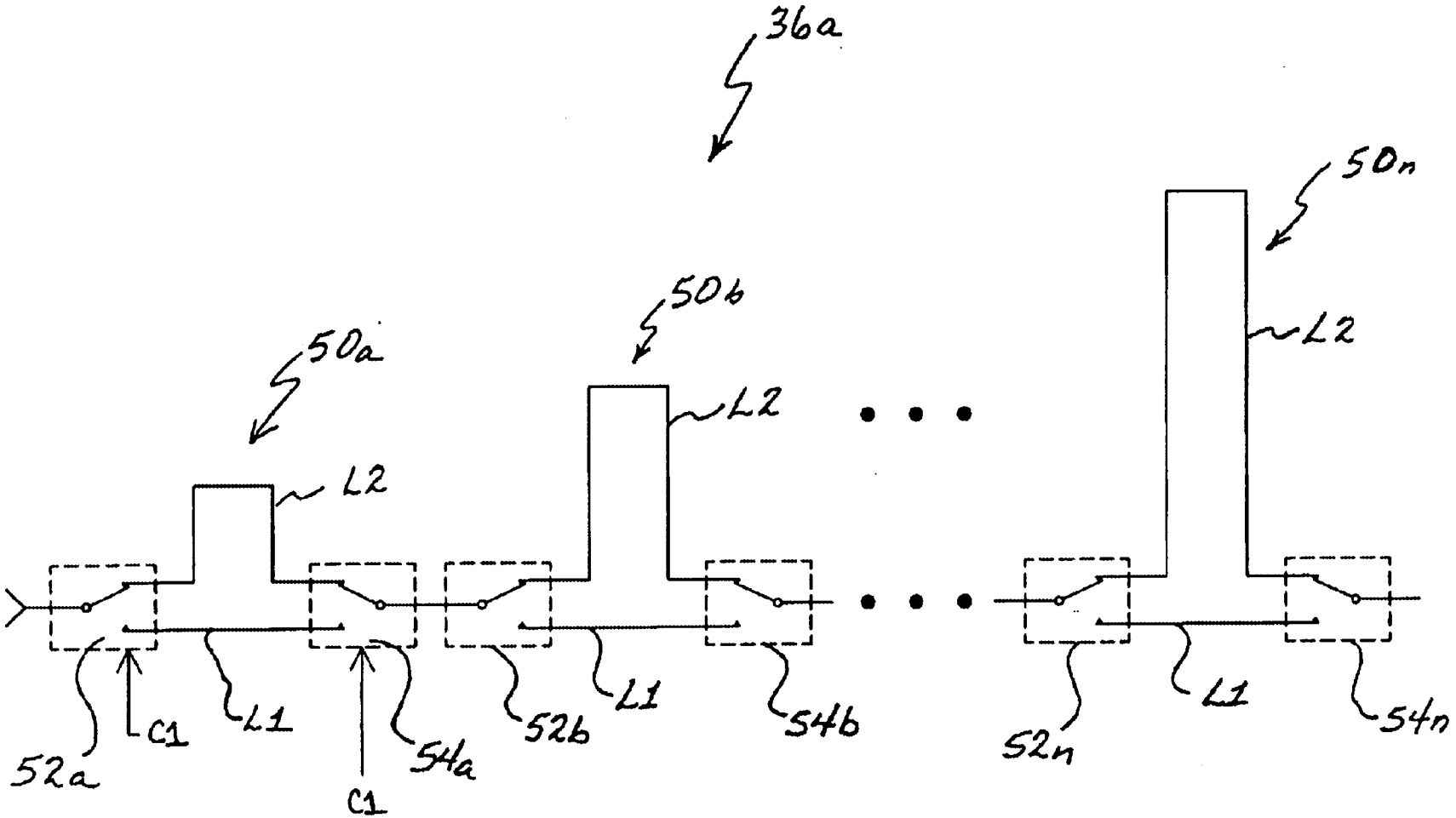
FIG. 4 is a schematic diagram of one of the time delay stages of FIG. 3 and sub-circuits thereof.

Time delay stages 36*a*–36*n* are substantially similar, and therefore a detailed description of one shall serve to describe the structure and functionality of all. Referring now to FIG. 4, an exemplary embodiment of time delay stage 36*a* is shown. Time delay stage 36*a* is configured as an n-bit time delay stage, and includes sub-circuits 50*a*, 50*b*, . . . , 50*n*.

Sub-circuit 50*a* includes a first single-pole double throw (SPDT) switch 52*a* that routes the RF input signal received from N-way divider 34 through one of a first delay/reference line L1 or a second delay line L2. A second SPDT switch 54*a* routes the delayed signal from one of delay line L1 or L2 to an output (not referenced) of sub-circuit 50*a* and, thus, to sub-circuit 50*b*. Switch 52*a*, in response to control signal C1, routes the RF signal through an indicated one of first and second delay lines L1 and L2. Switch 54*a*, in response to control signal C1, connects and/or routes the RF signal to sub-circuit 50*b*.

Switches 52*a*, 52*b*, . . . 52*n* and 54*a*, 54*b*, . . . 54*n* are substantially similar, and therefore a detailed description of one shall serve to describe the structure and functionality of all. Switch 52*a* is a SPDT integrated circuit monolithic microwave broadband switch, such as, for example, a gallium arsenide-based (GaAs) microwave switch, that operates up to a frequency of approximately 20 gigahertz (GHz). One commercially-available embodiment of a single-pole four throw (SP4T) configuration of such a switch is manufactured by TnQuint Semiconductor of 13510 N. Central Expressway, Dallas, Tex., 75243 as model number TGS2304-SCC.

Figure 5:
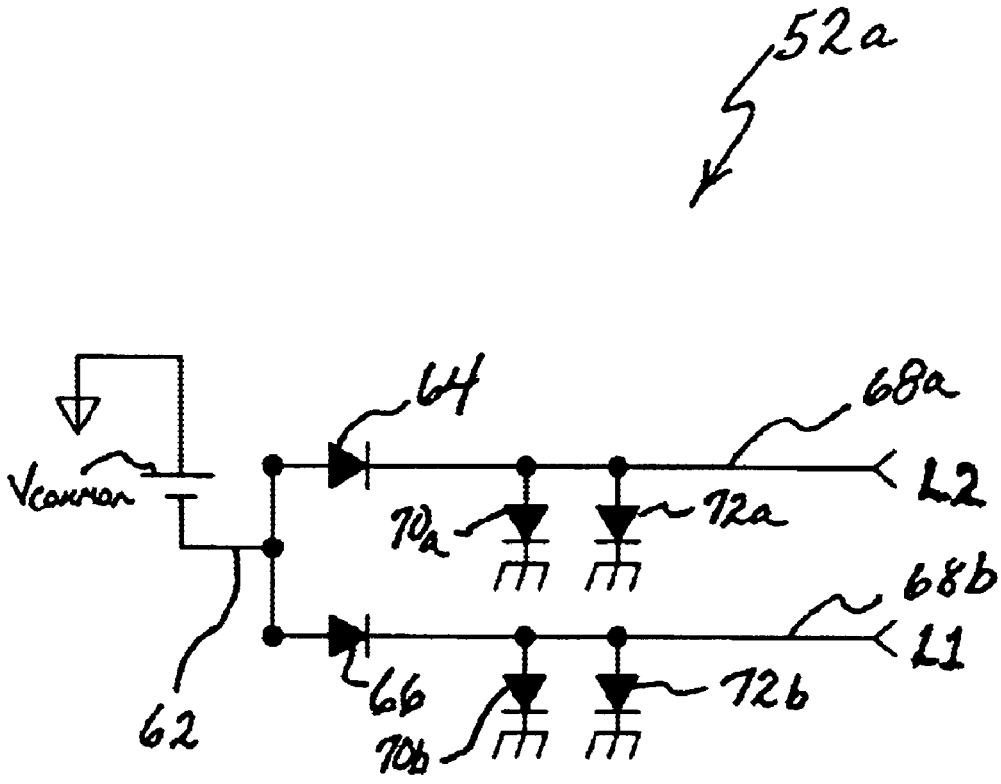
FIG. 5 is a schematic diagram of one embodiment of the switches shown in FIG. 4.

Referring now to FIG. 5, an equivalent schematic diagram of switch 52*a* is shown. Switch 52*a* includes input or common arm 62 that is electrically connected to series integrated diodes 64 and 66, and shunt arms 68*a* and 68*b* including shunt diodes 70*a*, 72*a* and 70*b*, 72*b*, respectively. Conventionally, common arm 62 would be connected to ground potential whereas shunt arms 68*a*, 68*b* would have a positive bias applied. Integrated monolithic switches, in general, have relatively limited operating power. In order to increase the operating power of switches 52*a*–52*n* and 54*a*–54*n*, the common arms thereof are each biased with a negative voltage. Thus, as shown in FIG. 5, common arm 62 is electrically connected with a voltage source $V_{COMMON}$ applying a negative voltage thereto. The magnitude of the negative voltage applied to common arm 62 by $V_{COMMON}$ is, for example, from approximately negative 1 volt to a negative maximum as established by the manufacturer's recommendations. Biasing switch 52*a* in the above-described manner increases the operating power thereof by enabling the input signal applied to common arm 62 to undergo a larger voltage swing.

Delay lines L1 and L2 are preferably configured as conventional microwave delay lines, with the length of each respective delay line L2 increasing by a factor of two relative to delay line L2 of the preceding sub-circuit, as is described more particularly hereinafter. Forming delay lines L1 and L2 as conventional delay lines, rather than integral with the corresponding monolithic integrated switches of the corresponding sub-circuit, enable microwave scanned antenna array system 30 to achieve longer delays relative to integrated delay lines. Integrating the delay lines with the corresponding monolithic integrated switches substantially limits the useable bandwidth of the delay lines that are achievable relative to conventional non-integral delay lines, since the monolithic delay lines which are configured as micro-strips are nonlinear.

As stated above, sub-circuits 50*a*–50*n* are substantially similar to each other in function and design and thus sub-circuits 50*b*–50*n* are not discussed in detail individually. Generally, each of sub-circuits 50*b*–50*n* include corresponding switches 52*b*–52*n* and 54*b*–54*n*, and each include delay lines L1 and L2. However, a distinction between sub-circuits 50*a*–50*n* is that the ratio of the lengths of their respective delay lines L2 to L1 increases by a factor of two from sub-circuit 50*a* to sub-circuit 50*b*, and from sub-circuit 50*b* to sub-circuit 50*c* (not shown), and so on. Thus, delay line L2 of sub-circuit 50*b* delays the RF signal twice as long as delay line L2 of sub-circuit 50*a*. Similarly, delay line L2 of sub-circuit 50*c* (not shown) delays the RF signal twice as long as delay line L2 of sub-circuit 50*b*. Delay/reference lines L1 of each of sub-circuits 50*a*–50*n* are substantially equal in length and in the amount of time by which they delay the RF signal.

Scanned antenna array system 30 has a substantially reduced number of discrete components relative to a conventional scanned antenna array system. For example, a conventional six-bit time delay sub-circuit requires two switches per bit, each switch having three diodes, for a total of thirty-six discrete switching PIN diodes, whereas a six-bit time delay sub-circuit of scanned antenna array system 30 requires two switches per bit for a total of twelve integrated switches. The reduction in discrete parts also substantially reduces the number of interconnects that must be made, thereby reducing circuit complexity and time required for assembly. Thus, by using integrated switches 52*a*, 52*b*, . . . 52*n* and 54*a*, 54*b*, . . . 54*n* the number of discrete components and interconnects required to implement scanned antenna array system 30 is substantially reduced relative to a conventional scanned antenna array system.

Relative to discrete PIN diode switches, the integrated switches are substantially identical to each other in terms of operating characteristics, and performance. The variation in the operational characteristics between integrated switches is substantially reduced relative to the variation between discrete PIN diode switches, and therefore the integrated switches more closely matched. Thus, the need to manually tune the sub-circuits in order to obtain an acceptable level of performance of antenna system 30 is substantially reduced. Further, since the integrated switches are more closely matched, the need for isolation devices between sub-circuits is substantially reduced.

It should be particularly noted that sub-circuits 50*a*–50*n*, and thus time delay stages 36*a*–36*n*, include no amplifiers or dividers. As described above, conventional time delay sub-circuits employ amplifiers to compensate for the insertion loss of the dividers. The amplifiers, however, render the conventional time delay sub-circuits non-reciprocal. Amplifiers are not required to compensate for any insertion losses due to dividers in sub-circuits 50*a*–50*n*. Therefore sub-circuits 50*a*–50*n* are reciprocal.

Figure 6:
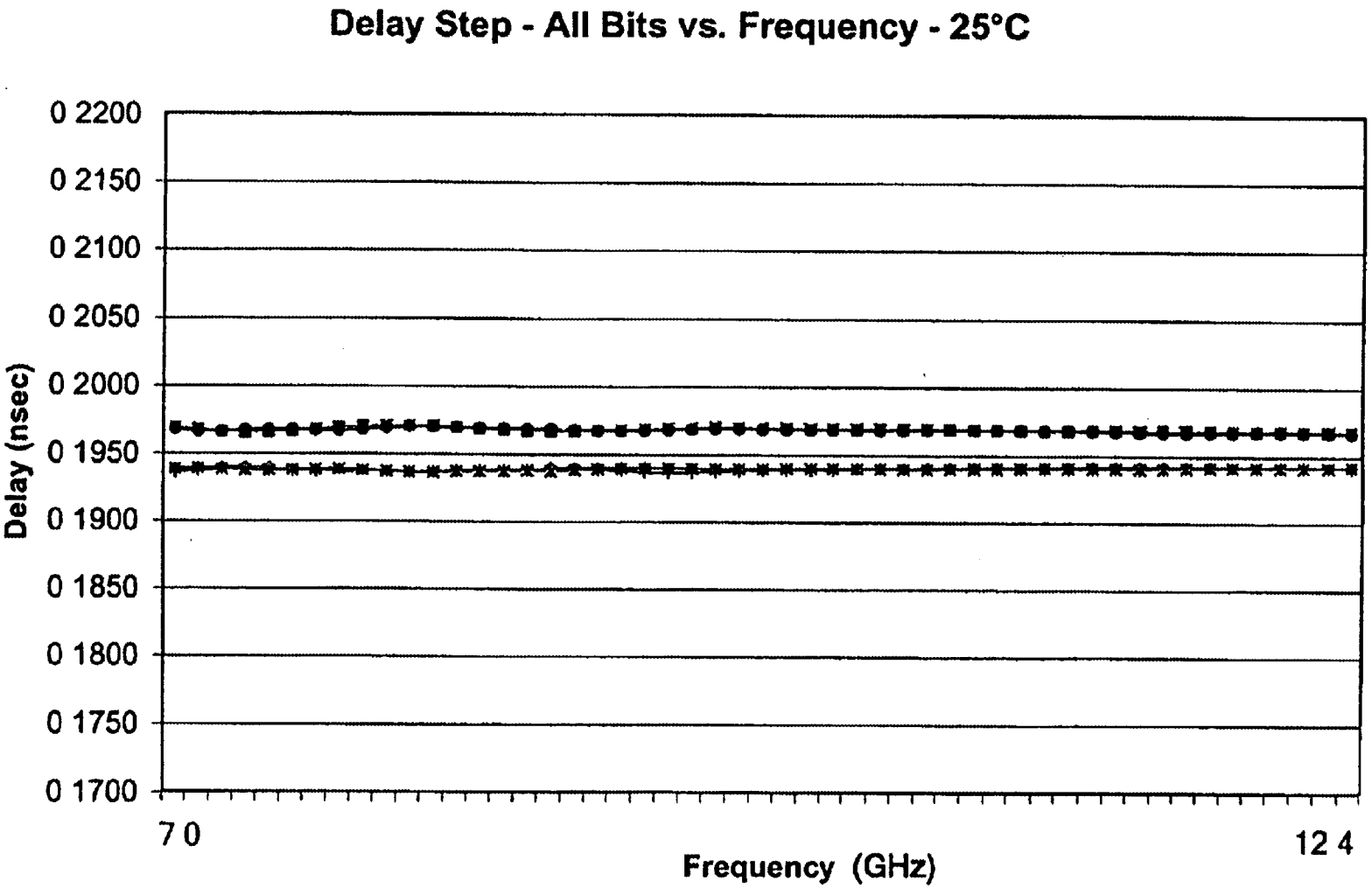
FIG. 6 is a graph showing delay time in nanoseconds vs frequency in gigahertz of the time delay stages of the present invention.
Figure 7:
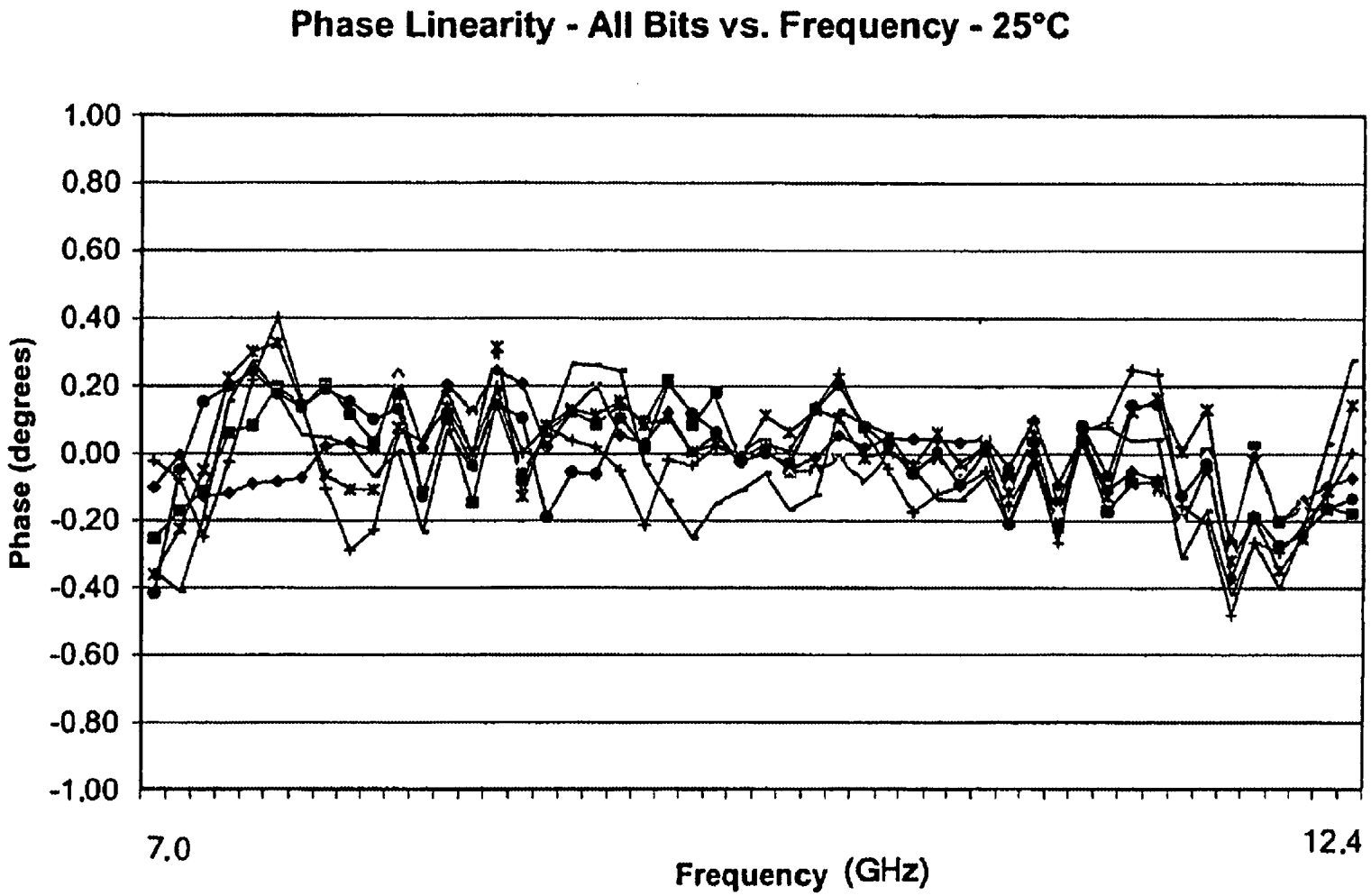
FIG. 7 is a graph showing the phase linearity in degrees vs. frequency in gigahertz of the time delay stages of the present invention.
Figure 8:
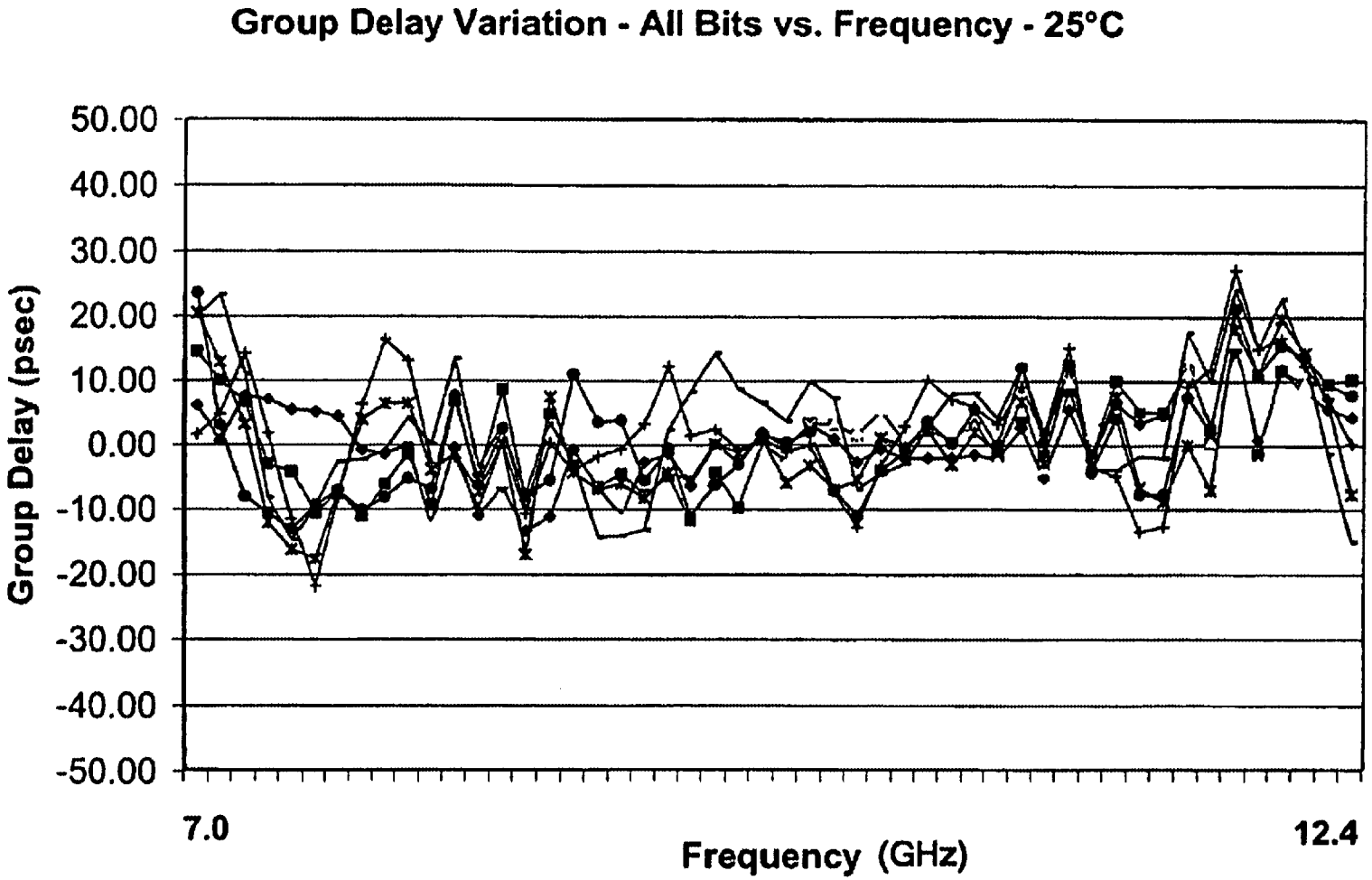
FIG. 8 is a graph showing the group delay variation in picoseconds vs. frequency in gigahertz between time delay stages of the present invention.

It should further be particularly noted that integrated switches 52*a*–52*n* and 54*a*–54*n*, and thus delay stages 36*a*–36*n*, can operate over a frequency range of from approximately 0.01 to 20 gigahertz with few bandwidth limitations relative to a conventional/discrete time delay stage. More particularly, as seen in FIG. 6, delay stages 36*a*–36*n* operate with a generally flat delay time over a frequency range of from approximately 7 GHz to 12.4 GHz (i.e., AX@ band). Further, as seen in FIG. 7, delay stages 36*a*–36*n* operate with generally constant phase over a frequency range of from approximately 7 GHz to approximately 12.4 GHz. Thus, delay stages 36*a*–36*n* have substantially reduced bandwidth limitations relative to conventional delay stages. Moreover, it should be particularly noted that the variation in the group delay times of different delay stages, as shown in FIG. 8, is substantially lower than the variation in group time delays between different conventional delay stages.

In the embodiment shown, antenna array system 30 is configured with N number of M-way dividers 42*a*–42*n*, each of which provide M antennae with time-delayed signals. However, it is to be understood that the present invention can be alternately configured with a varying number of dividers which divide the input signal by a varying number to thereby provide virtually any number of antennae with time-delayed signals.

In the embodiment shown, time delay stages 36*a*–36*n* are configured with N number of sub-circuits 50*a*–50*n*. However, it is to be understood that time delay stages can be alternately configured, such as, for example, as sub-circuits of a 3-bit, 4-bit or virtually any number of bit configuration.

In the embodiment shown, switches 52*a*–52*n* and 54*a*–54*n* are configured as SPDT switches. However, it is to be understood that switches 52*a*–52*n* and 54*a*–54*n* can be alternately configured, such as, for example, single-pole four throw switches.

In the embodiment shown, the common arms of switches 52*a*–52*n* and 54*a*–54*n* have a negative voltage/bias applied thereto. However, it is to be understood that the bias applied to the common arms of the switches can be varied within the range recommended by the switch manufacturer.

In the embodiment shown, delay lines L1 and L2 are configured as conventional delay lines. However, it is to be understood that delay lines L1 and L2 can be alternately configured, such as, for example, formed on a substrate either integral with or separate from the switches.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed:

1. A scanned antenna array, comprising:

at least one time delay stage, each said time delay stage having at least one time delay sub-circuit, each said time delay sub-circuit including a sub-circuit input and a sub-circuit output, each said time delay sub-circuit comprising:

a first delay line having a first and second end;

a second delay line having a first and second end;

a respective first diode switch connected to said corresponding sub-circuit input, said respective first diode switch connecting said first end of a selected one of said first and second delay lines to said sub-circuit input; and a respective second diode switch connected to said corresponding sub-circuit output, said second diode switch connecting said second end of said selected one of said first and second delay lines to said sub-circuit output, said sub-circuit output connected to one of another of said time delay sub-circuits or alternatively to an output of said time delay stage;

a respective transmit/receive (TR) module coupled to an output of each said time delay stage through an M-Way divider associated with said respective transmit/receive (TR) module, each said TR module issuing the respective TR module output signal; and a plurality of antenna elements coupled to an output of a corresponding one of said TR modules and radiating a respective TR module output signal received therefrom;

wherein each said first and second diode switch includes a respective common arm and at least one respective shunt arm, said common arms of at least one of said first and second diode switches being negatively biased relative to ground potential.

2. A time-delay stage for use in a scanned antenna array, said time-delay stage including at least one time delay sub-circuit having a sub-circuit input and a sub-circuit output, each said at least one time-delay sub-circuit comprising;

a first delay line having a first and second end;

a second delay line having a first and second end;

a first diode switch connected to said sub-circuit input, said first diode switch connecting said first end of a selected one of said first and second delay lines to said sub-circuit input;

a second diode switch connected to said sub-circuit output, said second diode switch connecting said second end of said selected one of said first and second delay lines to said sub-circuit output, said sub-circuit output connected to one of another of said time delay sub-circuits or alternatively to an output of said time-delay stage; and said first and second diode switch includes a respective common arm and at least one respective shunt arm, said common arms of at least one of said first and second diode switches being negatively biased relative to ground potential.

3. The time-delay stage of claim 2, wherein each of said first and second diode switches comprises a respective P-type semiconductor/Intrinsic/N-type semiconductor (PIN) diode switch.

4. The time-delay stage of claim 2, wherein each said respective first diode switch is responsive to a control signal to connect said first end of one of said first and second delay lines to said sub-circuit input.

5. The time-delay stage of claim 2, wherein each said second diode switch is responsive to a control signal to connect said second end of one of said respective first and second delay lines to said sub-circuit output.

* * * * *